US005254063A

United States Patent [19]

House, Jr.

[11] Patent Number: 5,254,063

[45] Date of Patent: Oct. 19, 1993

[54] BARBELL WITH ECCENTRIC WEIGHTS

[76] Inventor: Hugh A. House, Jr., P.O. Box 849, Rockwell, N.C. 28138

[21] Appl. No.: 785,992

[22] Filed: Oct. 31, 1991

[51] Int. Cl.[5] ..... A63B 21/075

[52] U.S. Cl. ..... 482/107; 482/106; 403/104; 403/372

[58] Field of Search ..... 482/106, 107; 403/104, 403/350, 357, 368, 372

[56] References Cited

U.S. PATENT DOCUMENTS

| | | | |
|---|---|---|---|
| 1,222,924 | 4/1917 | Boyd . | |
| 1,552,073 | 9/1925 | Mansfeldt . | |
| 3,319,954 | 7/1968 | Callahan | 403/372 |
| 3,457,786 | 7/1969 | Trent . | |
| 3,468,534 | 9/1969 | Donato . | |
| 3,502,329 | 3/1970 | Brazier . | |
| 3,544,106 | 12/1970 | Barrett . | |
| 3,588,102 | 6/1971 | Gifford . | |
| 3,717,857 | 2/1973 | Evans . | |
| 3,724,885 | 4/1973 | Becker | 403/104 |
| 3,756,597 | 9/1973 | Monti . | |
| 3,761,083 | 9/1973 | Buchner . | |
| 3,820,781 | 6/1974 | Kane . | |
| 3,904,198 | 9/1975 | Jones . | |
| 3,938,803 | 2/1976 | Wilmoth . | |
| 3,971,255 | 7/1976 | Varney . | |
| 4,376,533 | 3/1983 | Kilbel . | |
| 4,453,710 | 6/1984 | Plotz | 482/107 |
| 4,513,963 | 4/1985 | Nelson et al. . | |
| 4,518,162 | 5/1985 | Oates . | |
| 4,556,217 | 12/1985 | Kochan . | |
| 4,585,367 | 4/1986 | Gall | 482/107 |
| 4,603,854 | 8/1986 | Krausz . | |
| 4,623,146 | 11/1986 | Jackson . | |
| 4,664,373 | 5/1987 | Hait . | |
| 4,722,523 | 2/1988 | Yang . | |
| 4,743,016 | 5/1988 | Van Derworp et al. . | |
| 4,775,149 | 10/1988 | Wilson . | |
| 4,856,776 | 8/1989 | Ching-Liang . | |
| 4,863,158 | 9/1989 | Tassone | 482/106 |

*Primary Examiner*—Richard J. Apley
*Assistant Examiner*—Lynne A. Reichard

[57] ABSTRACT

The invention herein pertains to exercise equipment and particularly to an exercise bar which is placed long the shoulders, behind the neck of the user for various torso exercises. The exercise bar comprises a longitudinal member with weights on either side of the neck portion that can be slidably moved therealong or exchanged depending on the degree of resistance desired. One version of the exercise device includes a wall mount having a motorized system for electrically adjusting the weight elements along the longitudinal member while mounted.

5 Claims, 5 Drawing Sheets

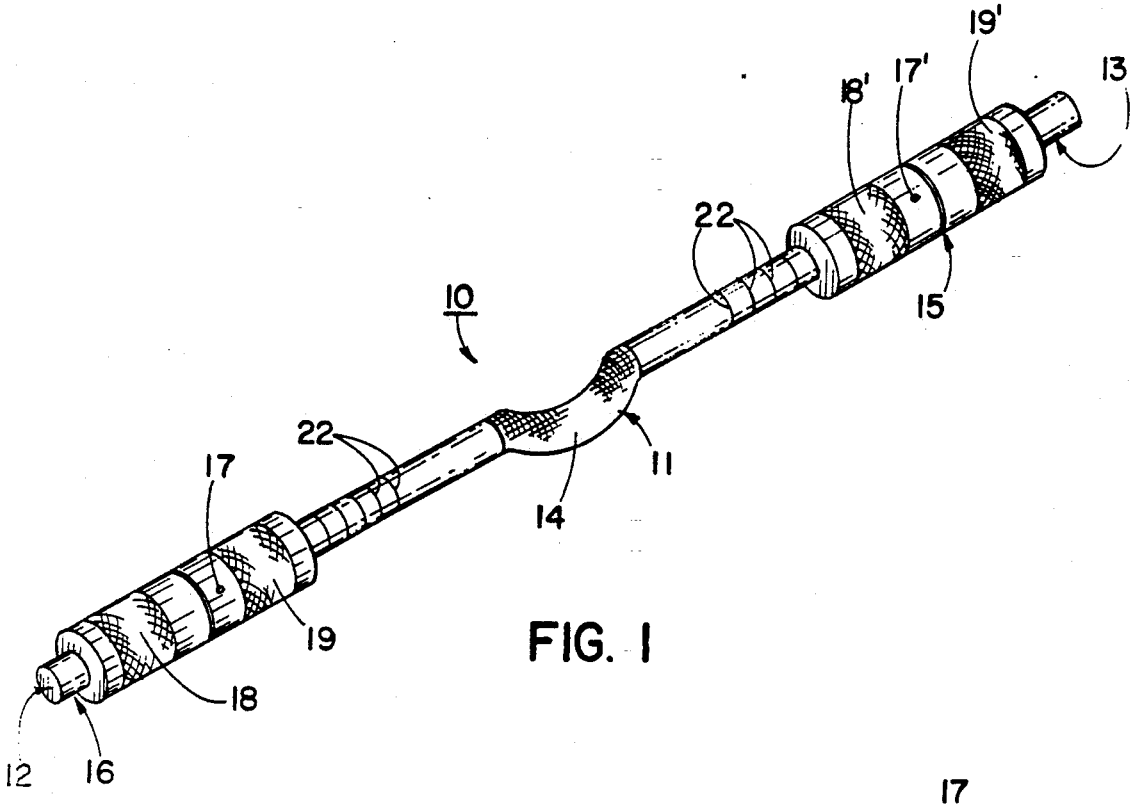
FIG. 1
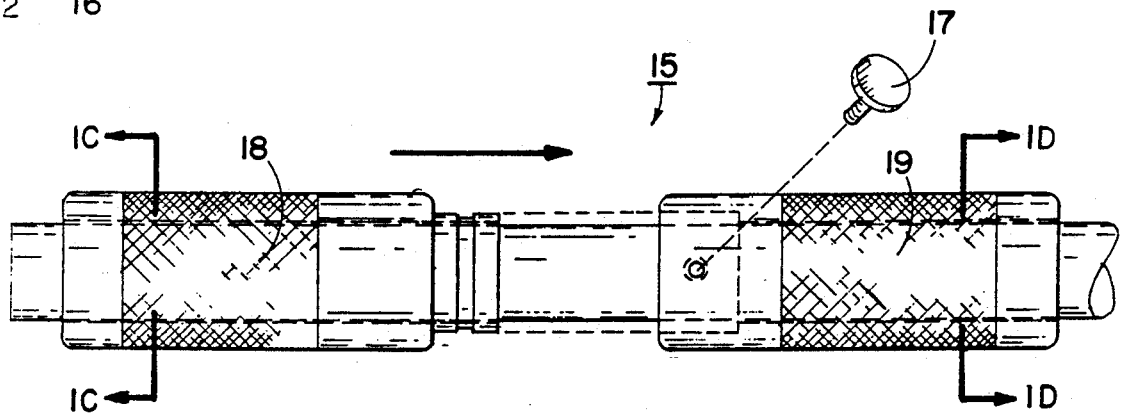
FIG. 1A
FIG. 1B
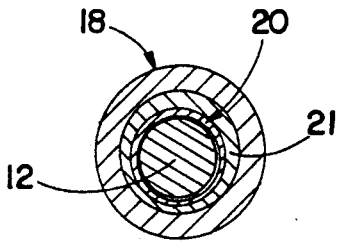
FIG. 1C
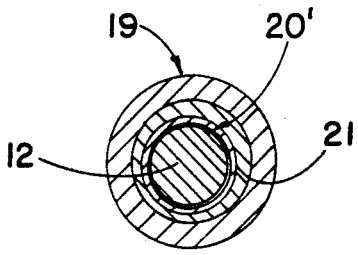
FIG. 1D

FIG. 5C
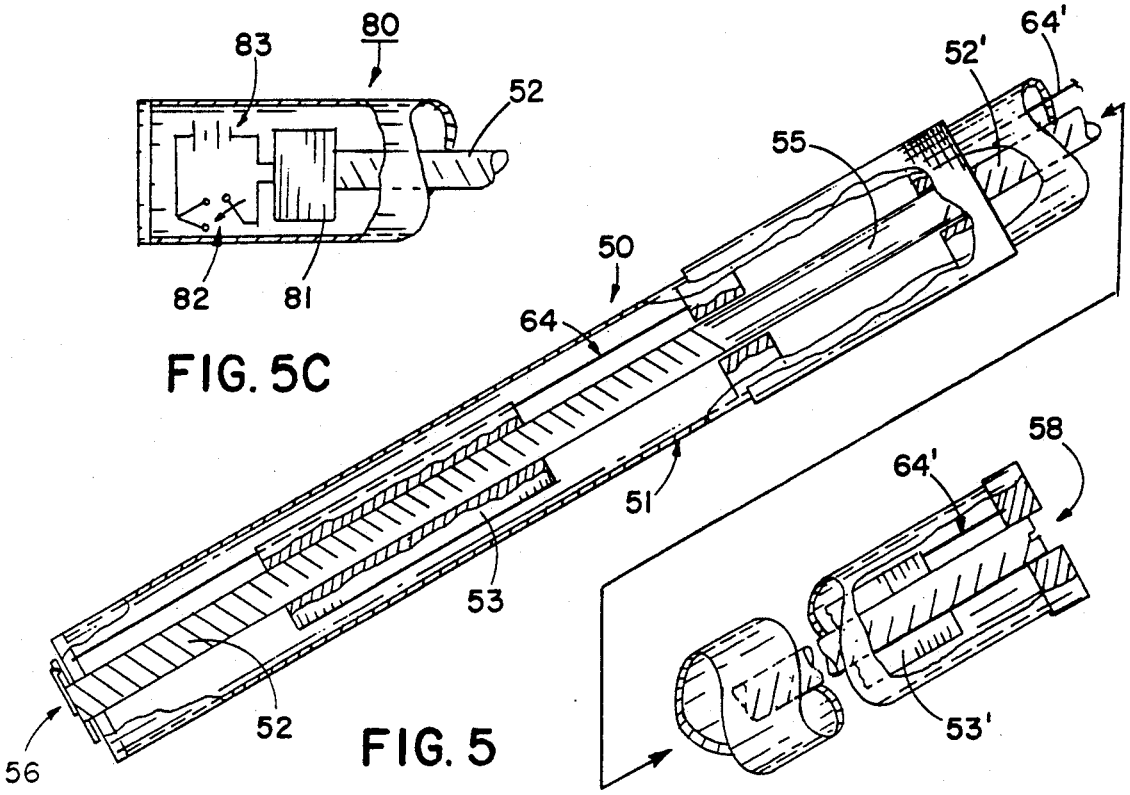
FIG. 5
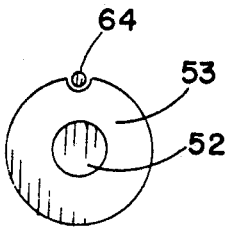
FIG. 5B
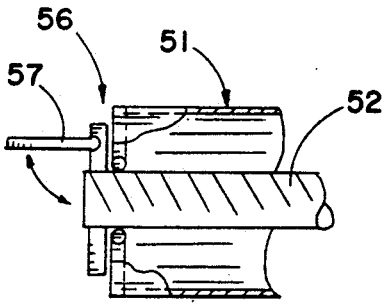
FIG. 5A

BARBELL WITH ECCENTRIC WEIGHTS

BACKGROUND OF THE INVENTION

1. Field Of The Invention

The present invention pertains to a portable exercise device for use by an individual and particularly to an elongated device for placement behind the neck having weights therealong which can be adjusted to increase or decrease the resistance to the muscles.

2. Description of the Prior Art and Objectives of the Invention

Barbells, dumbells and other types of portable exercise devices have long been used by those seeking healthy and physically fit bodies. In recent years tubular exercise "bars" have been developed which can be placed along the shoulders and behind the neck for various torso exercises. These bars may extend six or more feet in length and are generally weighted along each side for exercising the body torso including the waist. Such a device as described in U.S. Pat. No. 4,518,162. Another such exercise device is shown in U.S. Pat. No. 3,820,781 which includes a longitudinal bar having a concave yoke midsection and having weight bars affixed along either side of the yoke. While such prior exercise bar devices are somewhat useful, these devices are generally difficult and time consuming to adjust or vary the weights required. Thus, the present invention overcomes the difficulties and disadvantages of such previous devices and one of its objectives is to provide an exercise device which is comfortable to the user and which can be quickly varied or adjusted to the precise requirements of the individual.

It is another objective of the invention to provide an exercise device in the form of an elongated bar which, in one embodiment includes internal weight elements which can be easily adjusted therealong to the desires of the user.

It is yet another objective of the present invention to provide an exercise device which comprises a longitudinal member having weight elements mounted exteriorly therealong which are releasably slidable.

It is also another objective of the present invention to provide an exercise device which can be stored in a wall mount and which includes means for electrically adjusting the weight elements therein while mounted.

Various other objectives and advantages of the present invention become apparent to those skilled in the art as a more detailed description of the various embodiments is presented below.

SUMMARY OF THE INVENTION

The aforesaid objectives and advantages of the present invention are realized by utilization of an exercise device in the form of an elongated bar which includes a central neck portion which has been cushioned or padded and side portions having adjustable weight elements. In one embodiment of the invention the weight elements are internal of the longitudinal member and in another embodiment the weight elements are positioned exteriorly. In either embodiment the weight elements can be manually varied to provide different resistance for the muscle groups exercised thereby allowing the user to improve and increase muscle tone over a period of time by varying the weight elements, either or both in the amount of weight or their placement along the longitudinal member. The weight elements can be slid along the longitudinal member from the neck portion outwardly along each side and in another embodiment a motorized wall mount allows the user to adjust the weights before the exercise device is removed from the wall mount.

BRIEF DESCRIPTION OF THE DRAWINGS

FIG. 1 demonstrates in perspective view one embodiment of the invention with FIGS. 1A–1D demonstrating specific components thereof;

FIG. 5 pictures still another embodiment of the invention with FIGS. 5A and 5B showing specific parts thereof while FIG. 5C shows another embodiment;

DESCRIPTION OF THE PREFERRED EMBODIMENT

Figure 2:
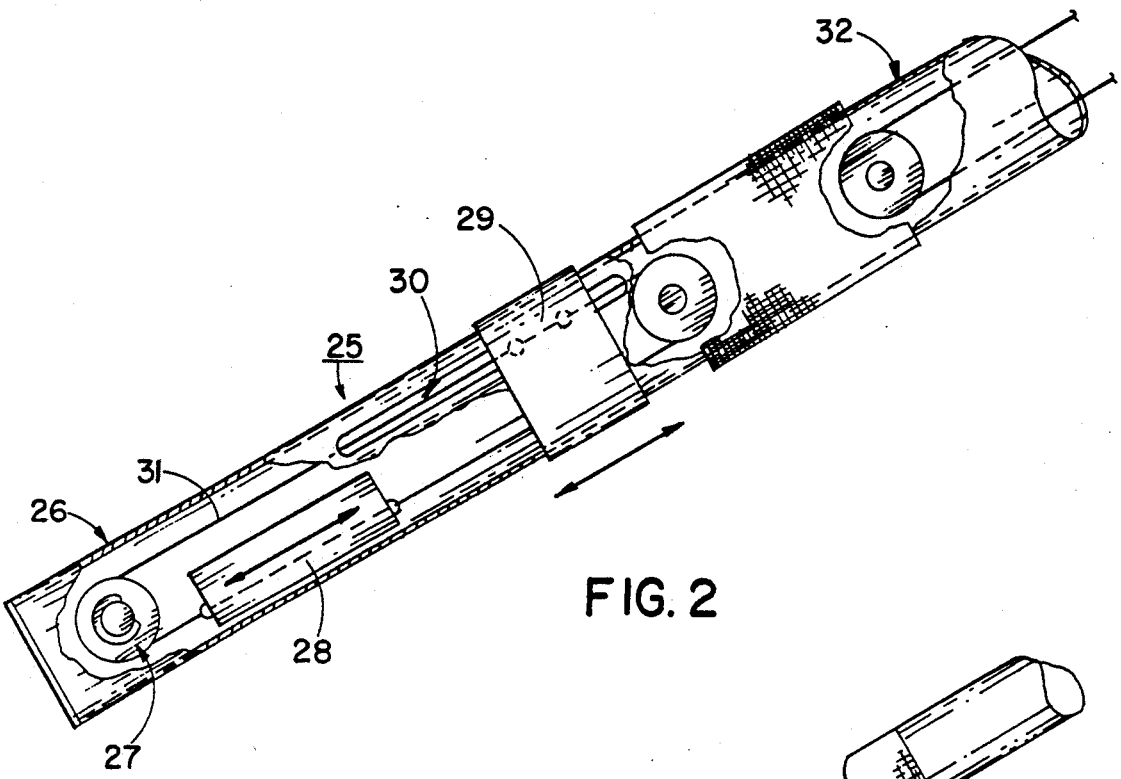
FIG. 2 shows another embodiment of the invention.

The preferred form of the invention is illustrated in FIG. 1 with certain parts thereof shown in more detail in FIGS. 1A–1D. The exercise device as seen therein is formed from an aluminum tube having a diameter of approximately one and one-quarter inches and having a wall thickness of approximately one-eighth of an inch. A curved neck yoke is provided in the central section which may be padded with foam rubber or other suitable materials for comfort during use. The overall length of the exercise device for an adult is approximately eighty-four inches. The device includes the central section with two side sections connected thereto approximately thirty inches in length which can be removed therefrom for transportation or storage purposes. Mounted on each of the side sections are weight elements which, as seen in FIGS. 1A and 1B, comprise two separate sections which are connected by a set screw and groove. The combined length of the two weight sections is approximately twelve inches. As shown in FIGS. 1C and 1D, the bore of the weights is slightly off center thereby forming an eccentric around a plastic sleeve positioned therein. The weight sections of the weight element can be rotated in opposite directions around the plastic sleeve to thereby loosen or tighten the sleeve which is deformable on the elongated side section. The weight sections can be rotated and slid along the elongated sections of the side section to a desired position As would be understood, each weight element would be positioned approximately the same distance from the yoke to insure balance of the device during use. Once in position the weight sections are rotated in opposite directions to tighten them on the side sections. The set screw is only used to maintain the weight sections together

DETAILED DESCRIPTION OF THE DRAWINGS AND OPERATION OF THE INVENTION

For a more complete understanding of the invention, turning now to the drawings, FIG. 1 shows the preferred form of the exercise device 10 having a central yoke section 11, a left elongated section 12 and a right elongated section 13. Sections 11, 12 and 13 are releasably, frictionally engaged and may be secured by set screws (not shown) or otherwise as desired. Yoke section 11 is arcuately shaped to fit around the back of the neck of the user and includes a padded material 14 such as vinyl covered foam rubber or the like to provide comfort for the user. Weight elements 15, 15' are slidably positionable along elongated sections 12 and 13 as desired. Indicia 22, 22' assist the user in precise positioning of weight elements 15, 15' and may be markings, grooves or the like. As further shown in FIG. 1, exercise device 10 comprises an elongated member 16 formed by left section 12, right section 13 and central yoke section 11. During torso exercises, it is oftentimes desirable to vary the resistance encountered by moving weight elements 15, 15' outwardly along the respective left and right sections 12 and 13. Weight sections 18 and 19, (18' and 19' not shown in 1A) as shown in FIGS. 1A and 1B are manually rotated in opposite directions. As seen in FIGS. 1C and 1D, left section 18 and right section 19 include bores 20, 20' which are slightly off center. Thus, by rotating sections 18 and 19 in opposite directions around elongated section 12, a force or pressure is applied to or released from deformable plastic tube 21, thereby tightening or loosening weight element 15 on elongated section 12. Set screw 17 is only used for fastening weight sections 18 and 19 together. The same procedure is then applied to weight element 15' on right elongated section 13 to insure device 10 is balanced.

In FIG. 2, another embodiment of the invention is shown whereby exercise device 25 comprises a left elongated section 26 having an internal pulley system 27. Weight element 28 is contained within elongated section 25 and is moved inwardly and outwardly by sliding handle 29. Handle 29 encircles left elongated section 26 and is movably positioned thereon A slot 30 allows cable 31 to be attached to exteriorly positioned handle 29. As would be understood, right elongated section 32 would include a similar weight and pulley system but is not shown completely herein for brevity.

Figure 3:
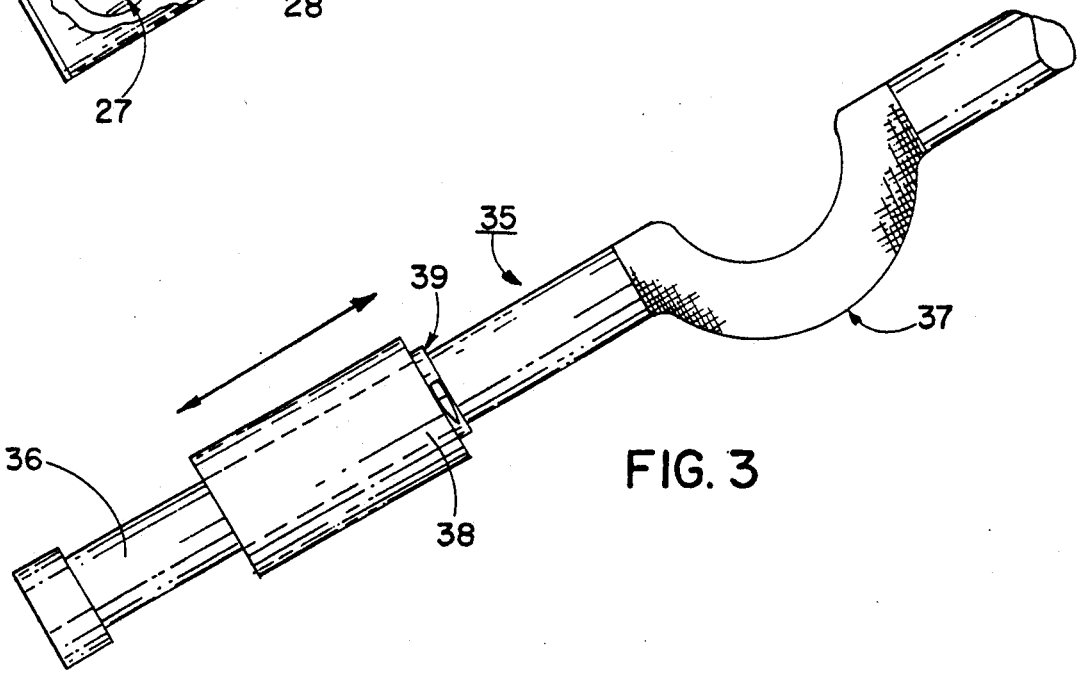
FIG. 3 illustrates a third embodiment of the invention with FIGS. 3A and 3B demonstrating particular features thereof.
Figure 3A:
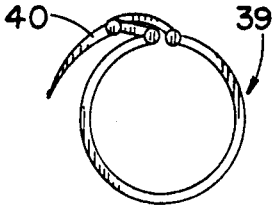
Figure 3B:
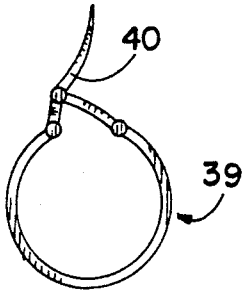

In the embodiment as shown in FIG. 3, exercise device 35 includes an elongated member 36 and an arcuate neck portion 37. Weight element 38 is slidably mounted thereon and is held in place by locking collar 39. Collar 39 is shown in more detail in FIGS. 3A and 3B and includes handle member 40 for ease in releasing and securing weight element 38 along elongated member 36 at the desired position.

Figure 4A:
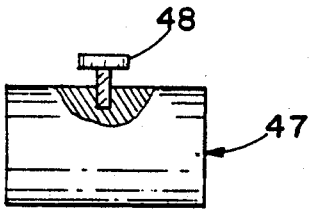
FIG. 4 depicts yet still another embodiment of the invention with FIG. 4A illustrating a weight element removed therefrom.
Figure 4:
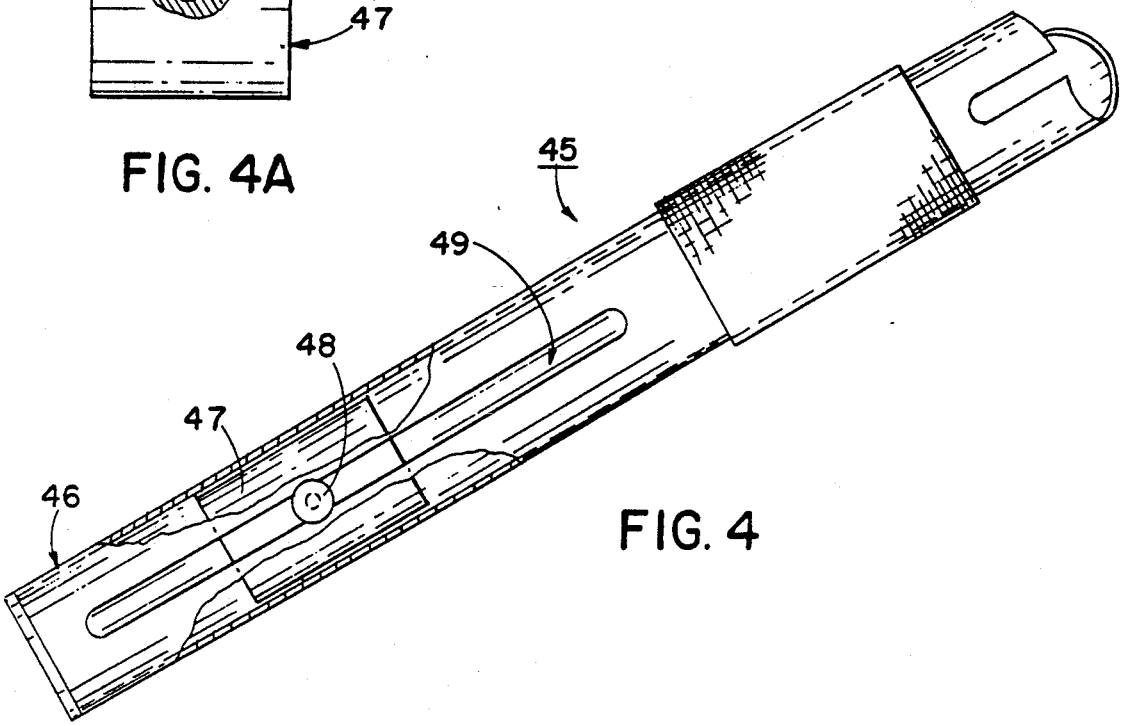

Another embodiment of the invention is shown in an abbreviated manner in FIG. 4 whereby exercise device 45 includes longitudinal member 46 which comprises a substantially hollow aluminum tube. Within longitudinal member 46 is slidably mounted weight element 47 which includes an exterior thumb screw 48. As would be understood only one portion of device 45 is seen whereby weight element 47 can be positioned along exercise device 45 at any desired location and thumb screw 48 (FIG. 4A) tightened through slot 49 to maintain element 47 in place during exercise.

Figure 7:
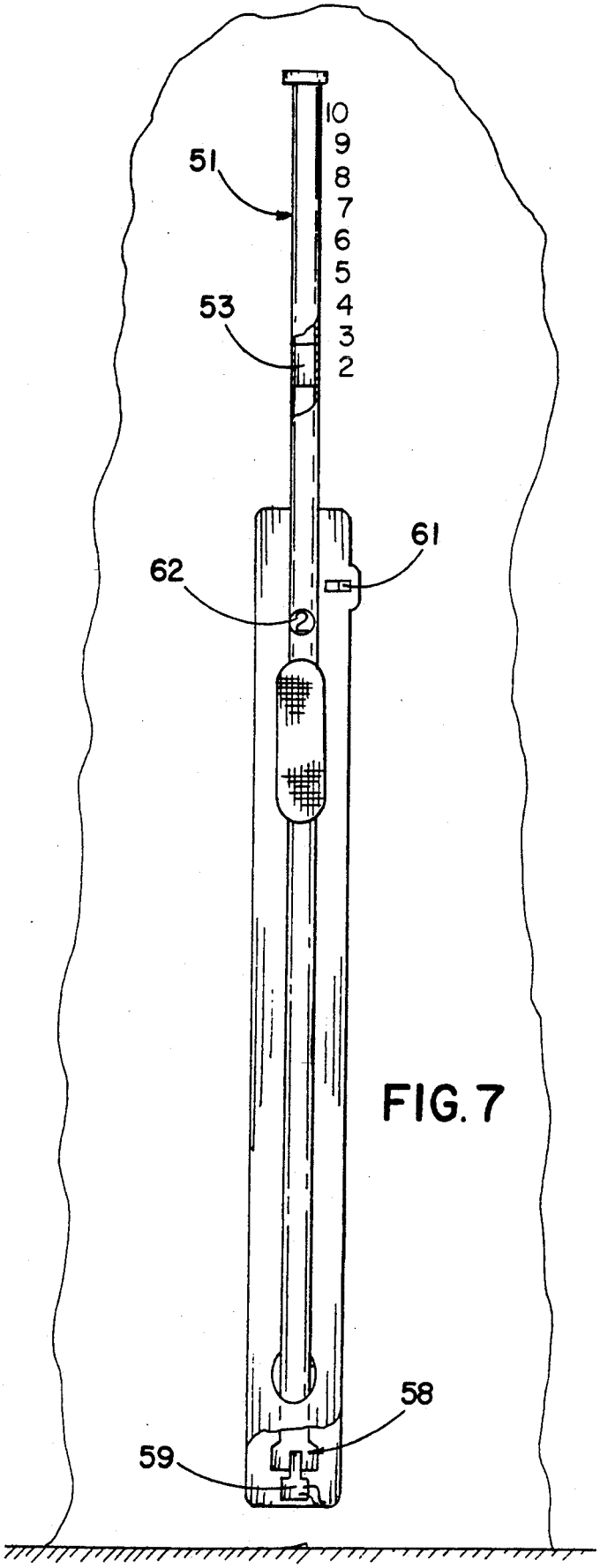
FIG. 7 illustrates the exercise device as shown in FIG. 5 in a wall mounted posture, with the mount having an electric motor.

In FIG. 5, another embodiment is shown whereby exercise device 50 comprises a longitudinal member 51 having a pair of threaded rods 52, 52' therein. Weight elements 53, 53' are received on threaded rods respectively 52, 52' and are joined through neck portion 54 by connecting rod 55 which is attached to threaded rods 52 and 52' and as illustrated, threaded rod 52 is oppositely threaded from rod 52'. Thus, upon rotation of threaded rod 52 such as by crank mechanism 56 as shown in FIG. 5A, connecting rod 55 and threaded rod 52 all turn simultaneously and weight elements 53, 53' move in opposite directions, also simultaneously. As further shown in FIG. 5A, crank mechanism 56 includes foldable handle 57 which can be closed downwardly as seen in FIG. 5 for storage purposes. In FIG. 5B, guide 64 prevents weight element 53 from rotating on threaded rod 52. Guides 64, 64' consist of a thin metal wire. When needed, handle 57 is manually raised and crank mechanism 56 rotated to adjust the positions of weight elements 53, 53'. As further shown in FIG. 5, threaded rod 52 includes shaft receptacle 58 for motorized rotation of threaded rod 52'. As depicted in FIG. 7, electric motor 59 is conveniently positioned within holder 60 which may be for example, wall mounted in a gym or spa. Receptacle 58 can thus be positioned on the shaft of motor 59 which is controlled by two-way switch 61. Weight elements 53, 53' can be moved by switch 61 to correspond to the series of numbers along longitudinal member 51 as shown in FIG. 7. An electronic weight position indicator 62 is also seen in FIG. 7 and provides a numerical indication of the position of weight 53 corresponding to the vertical background numbers in FIG. 7 along longitudinal member 51.

In FIG. 5C exercise device 80 which is similar to device 50, is shown in abbreviated form. In place of crank mechanism 56, electric motor 81 is joined to threaded rod 52. Schematic double pole switch 82 will allow current from battery 83 to motor 81 for driving rod 52 in either a clockwise or counterclockwise direction to move the weight therealong as further seen in FIG. 5.

Figure 6:
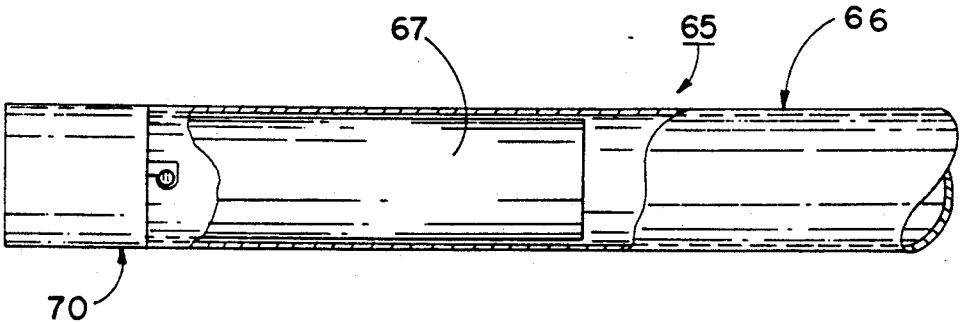
FIG. 6 shows a portion of another embodiment of an elongated exercise bar with FIG. 6A demonstrating the weight element removed from the end of the longitudinal member.
Figure 6A:
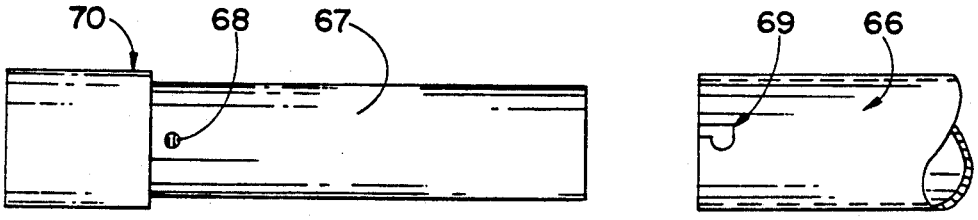

Another schematic view of a portion of an exercise device 65 is seen in FIG. 6. Only one end of longitudinal member 66 is shown and as would be understood a neck portion would be included approximately midway therealong with a duplicate side or end therebeyond. In exercise device 65, weight 67 is positioned therein and is locked in place by cooperatively engaging post 68 within locking slot 69 as seen in more detail in FIG. 6A. Thus, weight element 67 having an enlarged end or tip 70 can come in a variety of lengths and weights for easily placement and subsitution within longitudinal member 66.

The illustrations and examples provided herein are for explanatory purposes and are not intended to limit the scope of the appended claims.

I claim:

1. An exercise device comprising: an elongated member, having a central section, a pair of weight elements, said elements movably positioned upon said elongated member on each side of said central section, each of said weight elements comprising a left and a right rotatable weight section, a means to lock said weight elements on said elongated member, said locking means affixed to said weight elements, a means to secure left and right weight sections together, said securing means allowing opposite rotation of said weight sections on said elongated member, said securing means affixed to one of said weight sections each of said weight sections defining a bore, said bores positioned slightly off center, a flexible tube, said tube fitted within said bores whereby rotating one section in a first direction around said elongated member while simultaneously rotating the other section in an opposite direction will deform said flexible tube to tighten said weight element on said elongated member.

2. An exercise device as claimed in claim 1 wherein said locking means comprises a releasable collar.

3. An exercise device as claimed in claim 1 wherein said weight section securing means comprises a threaded member, said threaded member tightenable against said weight sections.

4. An exercise device as claimed in claim 1 wherein said elongated member comprises indicia, said indicia comprising a plurality of circular markings at spaced intervals around said elongated member.

5. An exercise device as claimed in claim 4 wherein said circular markings are positioned on both sides of said central section.

* * * * *